United States Patent [19]

Matti

[11] Patent Number: 4,998,456

[45] Date of Patent: Mar. 12, 1991

[54] BODY CONSTRUCTION OF A WIND INSTRUMENT AND PROCEDURE FOR PRODUCING A WIND INSTRUMENT WITH SAID CONSTRUCTION

[76] Inventor: Matti Kähönen, Porvoonkatu 37 A 4, 00520 Helsinki, Finland

[21] Appl. No.: 313,979

[22] PCT Filed: Jun. 8, 1988

[86] PCT No.: PCT/FI88/00088

§ 371 Date: Mar. 1, 1989

§ 102(e) Date: Mar. 1, 1989

[87] PCT Pub. No.: WO88/09986

PCT Pub. Date: Dec. 15, 1988

[30] Foreign Application Priority Data

Jun. 8, 1987 [FI] Finland ..... 872561

[51] Int. Cl.[5] ..... G10D 7/02

[52] U.S. Cl. ..... 84/384; 84/452 P

[58] Field of Search ..... 84/380, 384, 452

[56] References Cited

U.S. PATENT DOCUMENTS

| | | | |
|---|---|---|---|
| 1,455,440 | 5/1923 | Hofinger | 84/380 X |
| 2,219,434 | 10/1940 | White | 84/380 R |
| 3,308,706 | 3/1967 | Brilhart | 84/380 R |
| 3,880,040 | 4/1975 | Kaman | 84/291 |
| 4,145,948 | 3/1979 | Turner | 84/293 |
| 4,364,990 | 12/1982 | Haines | 84/184 |
| 4,408,516 | 10/1983 | John | 84/275 |

*Primary Examiner*—Lawrence R. Franklin

*Attorney, Agent, or Firm*—Toren, McGeady & Associates

[57] ABSTRACT

The present invention concerns the body structure of a wind instrument and a procedure for making a wind instrument body presenting said structure. The body of a wind instrument, such as a flute, consists of an elongated tube composed of one or several parts (1), in said tube apertures (2) openable and closable with separate keys as required by playing, are made. As taught by the invention, the tube or its parts are made of plastic material, with which one or several fiber courses (4,5) are combined for reinforcement. An appropriate plastic material is epoxy plastic, and appropriate fibers are e.g. carbon fibres. With these is obtained a body construction which has a high rigidity and low mass and which produces sound with minimal blowing energy.

3 Claims, 1 Drawing Sheet

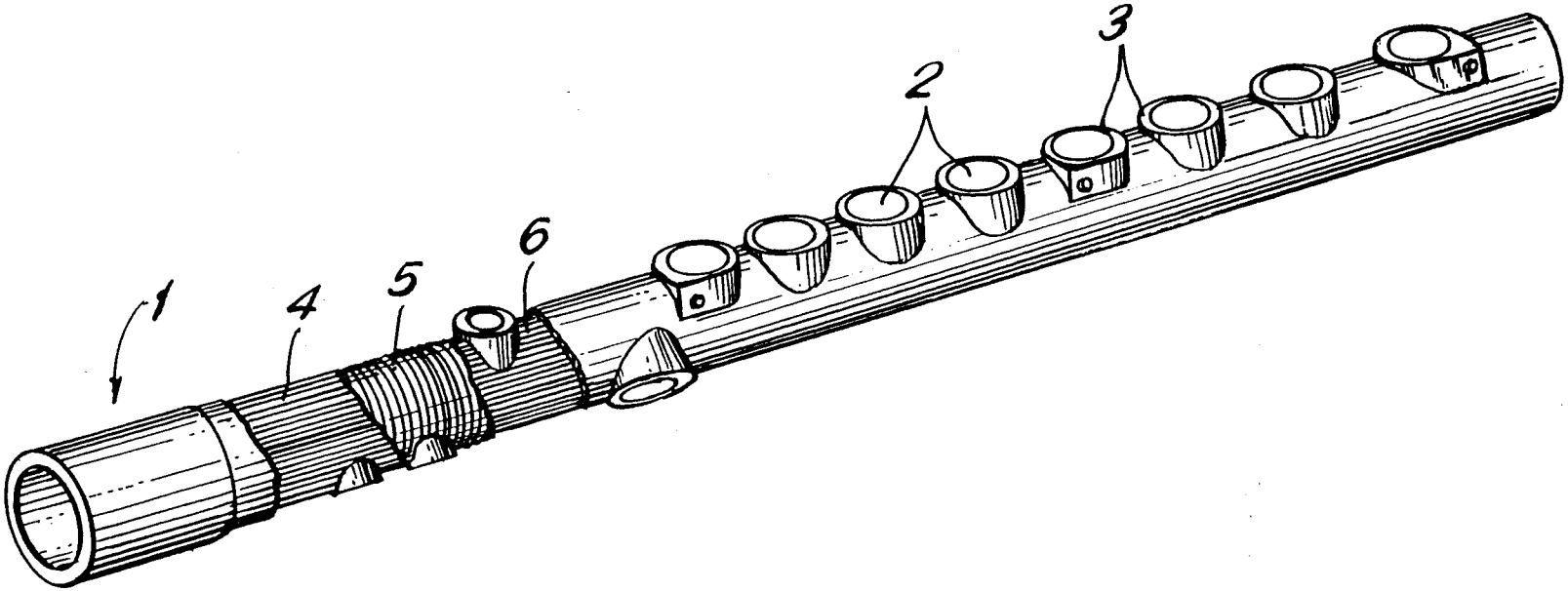
3
2
6
5
4
1

BODY CONSTRUCTION OF A WIND INSTRUMENT AND PROCEDURE FOR PRODUCING A WIND INSTRUMENT WITH SAID CONSTRUCTION

The present invention concerns a body construction of a wind instrument, applying which an elongated tube composed of one or several parts consisting of the body has been constructed, in which have been provided apertures openable and closable with separate keys as required for playing.

The tubular body parts of wind instruments, such as flute, oboe, clarinet and bassoon, where in earlier times made of timber, wherefrom originates the common name of said instruments: woodwinds. Later however, other materials, in particular metals, have replaced wood. For instance, in the flute metal has since the 19th century been the dominant material even though the use of other materials, such as ceramics and glass has been known in the art.

The sound of a wind instrument within the tubular body of the instrument is generated by an oscillating air oclumn. The pitch of the sound depends on the length of the column, and for generating sounds of different pitches, apertures in the body are made, these bring openable and closable by the player with the aid of a separate key mechanism mounted on the body.

A significant matter regarding the playing properties of a wind instrument is the weight of said body, wherewith the blowing energy required for producing a sound is inversely proportional. Another equally significant matter is the rigidity of the body tube and the hardness of its inner surface; in a rigid tube it is easy to produce a sound while a soft tube generates a sound-absorbing effect. The optimal material of the body is such in which the ratio of rigidity and weight is most optimal, and in this respect, the metals have provided the best alternative up to date.

The object of the present invention is to provide a new design with which the playing properties of the instrument concerning the body structure of the instrument and the materials used therein can be made to be better than before. The invention is characterized in that the tube or its parts are made of plastic material reinforced with one or several fibre courses.

The instrument body of fibre-reinforced plastic of the invention can be made substantially lighter than the metal bodies used up to date, not to speak of the wooden bodies of old instruments. The fibre-reinforced plastic can be produced to be extremely rigid so that the ratio of body rigidity and weight essential from the point of view of the playing properties is provided to be on the whole more advantageous than in instrument bodies known in the art. The sound is therefore produced by using less blowing force, which facilitates the playing and therewith, also the learning to play.

An advantageous design of the invention is that the tube consisting of the body of the instrument or parts thereof, is/are made of epoxy plastic reinforced with carbon fibres, silicone carbide fibres, or boron fibers. For trying out the invention, a handmade flute has been produced from carbon fibres and epoxy plastic which in trial playing has entirely proved up to the expectations as to its playing properties and also tone quality. The body weight of the trial instrument was reduced to 26 g, which is a notable improvement over the conventional flute, the weight of its metal body being about 125 g, or with a flute made of wood, in which the body weight is about 250 g.

The present rigidity in the instrument body is gained by arranging the fibres to run in parallel with the body tube or its parts. However, it is moreover advantageous to arrange a second, transversal fibre course on the tube, with which the longitudinal cracking of said tube is prevented.

The present invention also concerns a procedure for making the body of a wind instrument comprising of the construction described above, in which procedure the body composed of one or several tubular parts is produced by making the tubular parts corresponding to said parts and providing them with apertures openable and closable with separate keys as required by playing. As taught by the invention, the tubular pieces are made of plastic material, with which are combined one or several fibre courses for reinforcement.

The above flute body produced as a trial piece was handmade using an elongated, rod-like piece as a mould. However, the procedure which can be considered in industrial serial manufacturing concerns primarily production of the tube by means of extrusion process. The extrusion process of fibre-reinforced plastic tubes is known in the art in other fields of technology, for instance in manufacturing ski sticks.

The body tube of the instrument is obtained in extrusion, or equivalent production process as an integral tubular piece, through which no apertures are made. In said tubular piece, the requisite collars for apertures are made by moulding, e.g. by extruding, whereafter the apertures are opened by cutting or boring in the middle of the collars. After the body has been finished, a key mechanism is mounted thereon, its keys being so placed in register to the apertures that the apertures can therewith be opened and closed by the player.

Furthermore, the present invention concerns the use of plastic material and of one or several fibre courses serving as reinforcement for the construction element of said tubular body of a wind instrument. Said plastic material is advantageously epoxy plastic, and said fibres are advantageously carbon, silicon carbide or boron fibres. The instrument is most preferably one of the so-called wood winds, flute in particular.

The invention is described in the following more in detail with the aid of examples, referring to the drawing attached, which presents a partly cut open part of the flute body, in which the body construction of the invention is used.

In the FIGURE is presented the centre part 1 of a flute body, constructed as taught by the invention, which is composed of three successive tubular parts, said centre part being provided with apertures 2 as required for playing. In addition to the centre part 1, the flute body comprises a front part provided with a mouthpiece, and a shorter rear part provided with apertures, their construction being equally taught by the invention. The body is provided with a separately mountable key mechanism composed of one or several parts, the keys thereof being arranged to be depressed against the collars 3 of the apertures 2 in that sounds of different pitches can be produced by opening and closing the apertures. However, the mechanism is omitted in the figure as a non-essential feature from the point of in invention.

The essential feature of the invention is the construction of the tubular body 1, to demonstrate which the FIGURE shows part of the body cut open in courses.

The body consists of epoxy plastic, in which three layers of carbon fibres are so immersed that in the innermost and the outermost courses 4, 6, in which the fibres are more closely located, the fibres are placed longitudinally, and in the centremost layer 5, in which the fibres are less close to one another, the fibres are placed transversally to the body, at a about 90° angle as to the fibres of the innermost and outermost courses. The collars 3 of the apertures 2 located in the body are likewise made of epoxy plastic.

The function of the longitudinal carbon fibres in the inner and outer courses of the tubular body is to provide said body with sufficient rigidity, and the purpose of the tranversal carbon fibres there in the middle is to prevent the body from cracking. Using epoxy plastic and carbon fibres, an extremely rigid body construction is produced, its weight being only about one fifth of the weight of a corresponding flute body made of a metal.

In order to test the properties of a flute consisting of the body construction of the invention, a trial piece was handmade, its body being similar to the one described above. Said trial piece is referred to in the foregoing. The body was made by using for the mould a PVC tube coated with a parting agent, wherearound a bundle of carbon fibre filaments, dipped in epoxy plastic, were stretched so that the filaments in the tube direction constituted a uniform course surrounding annularly the tube. The filament course saturated by the plastic was surrounded by tape, which was removed after the plastic had become solidified. Thereafter, another course of filaments saturated with epoxy plastic was produced by wrapping on top of the course on the plastic tube spirally a carbon fibre filament dipped in epoxy plastic, simultaneously rotating said plastic tube. The course was surrounded by tape which was removed after the plastic had become solidified. Thereafter, one more course of carbon fibre filaments dipped in plastic and placed now longitudinally to the tube was produced in the manner described above. Finally, the flute body tube thus obtained, and the mould tube wherein were so much heated that the mould tube could be detached. On the integral body tube thus obtained were moulded epoxy plastic collars for the apertures, whereafter the apertures were bursted in the middle of the collars by means of boring. All successive parts of the flute body were prepared in a similar manner, and finally, the flute was provided with a key mechanism.

In industrial serial production, the tubular body of the invention for a wind instrument can be manufactured e.g. by extruding as a continuing process. The fibres serving as reinforcement are thereby conducted into a plastic containing basin, wherefrom they are pulled into an annular space defined by the outer tube of the extruderer and an inner mandrel, in which space the tube is formed. After being extruded, the tube is cut into pieces of desired length, in which pieces apertures and collars for them are made by extruding and boring.

It is obvious to a person skilled in the art that the various embodiments of the invention are not confined to the examples presented in the foregoing, and they may vary within the scope of the claims presented below.

I claim:

1. A body construction of a flute, comprising an elongated tube composed of at least one part, the tube being provided with openable and closable apertures for playing, the tube, or its parts consisting of an epoxy plastic material reinforced with carbon fibres.

2. Construction according to claim 1, wherein the fibres are arranged crosswise in at least two layers.

3. Construction according to claim 1 wherein the fibres are arranged to run parallel with the tube or its parts.

* * * * *

UNITED STATES PATENT AND TRADEMARK OFFICE

CERTIFICATE OF CORRECTION

PATENT NO. : 4,998,456

DATED : March 12, 1991

INVENTOR(S) : Matti Kähönen

It is certified that error appears in the above-identified patent and that said Letters Patent is hereby corrected as shown below:

Title page:

Item (19); Inventor's last name should read -- Kähönen--.

Signed and Sealed this

Twenty-first Day of July, 1992

*Attest:*

DOUGLAS B. COMER

*Attesting Officer*

*Acting Commissioner of Patents and Trademarks*